US007962088B2

(12) United States Patent
Sasamoto et al.

(10) Patent No.: US 7,962,088 B2
(45) Date of Patent: Jun. 14, 2011

(54) BOOKMAKING APPARATUS AND IMAGE FORMING SYSTEM USING THE SAME

(75) Inventors: Shinya Sasamoto, Hokuto (JP); Hideya Fujihara, Nirasaki (JP)

(73) Assignee: Nisca Corporation, Yamanashi (JP)

( * ) Notice: Subject to any disclaimer, the term of this patent is extended or adjusted under 35 U.S.C. 154(b) by 1095 days.

(21) Appl. No.: 11/519,074

(22) Filed: Sep. 12, 2006

(65) Prior Publication Data

US 2007/0086877 A1 Apr. 19, 2007

(30) Foreign Application Priority Data

Sep. 13, 2005 (JP) ..... 2005-265933

(51) Int. Cl.
*B42C 9/00* (2006.01)
*B65H 37/02* (2006.01)

(52) U.S. Cl. ..... 399/408; 399/395

(58) Field of Classification Search ..... 399/408, 399/395, 85, 388; 412/20; 271/233, 245; 270/58.17, 58.27, 58.12; *B65H 37/02; B42C 9/00, B42C 11/06*

See application file for complete search history.

(56) References Cited

U.S. PATENT DOCUMENTS

2004/0096253 A1 * 5/2004 Ueno et al. ..... 399/385
2004/0141830 A1 * 7/2004 Yoshie et al. ..... 412/1

FOREIGN PATENT DOCUMENTS

| | | | |
|---|---|---|---|
| JP | 2001-80235 A | | 3/2001 |
| JP | 2003-25759 A | | 1/2003 |
| JP | 2003-291560 | | 10/2003 |
| JP | 2003291560 A | * | 10/2003 |
| JP | 2004-114197 A | | 4/2004 |
| JP | 2004-209869 | | 7/2004 |
| JP | 2005-254623 | | 9/2005 |
| JP | 2007-045040 | | 2/2007 |

* cited by examiner

*Primary Examiner* — Daniel J Colilla
*Assistant Examiner* — Jennifer Simmons
(74) *Attorney, Agent, or Firm* — Manabu Kanesaka

(57) ABSTRACT

In a bookmaking apparatus, a sheet bundle applied with adhesive in the apparatus when conveyance trouble, i.e., a cover sheet paper jam, occurs, is not left in the apparatus. Furthermore, the apparatus does not leave a cover sheet in the apparatus to be soiled if adhesive from a heated sheet bundle drops. The apparatus includes a sheet holding device for holding a sheet bundle at a predetermined adhesive application position, an adhesive application device for applying adhesive to the sheet bundle at the adhesive application position, and a cover sheet conveyance device for conveying the cover sheet to a binding position arranged at a downstream side of the adhesive application position.

9 Claims, 6 Drawing Sheets

BOOKMAKING APPARATUS AND IMAGE FORMING SYSTEM USING THE SAME

BACKGROUND OF THE INVENTION AND RELATED ART STATEMENT

The present invention relates to bookmaking apparatus, and more particularly to an apparatus that prevents a sheet bundle applied with adhesive from remaining inside the apparatus when the apparatus experiences conveyance malfunctions thereby allowing the adhesive to harden. The present invention further relates to a bookmaking apparatus that prevents adhesive applied to the sheet bundle from dripping into and contaminating the machine when bookbinding.

Generally, bookmaking devices are widely used as end devices of image forming apparatus such as printers or copiers, and as apparatus that binds a side of sheets formed with images to a cover sheet after stacking the sheets in page order, forming a bundle, and dispensing adhesive to that side, a variety of systems have been proposed that print predetermined information and at the same time automatically bind sheets, as an on-demand printing system, such as in electronic publication systems. This kind of bookmaking apparatus is used as a device that is separate from an image forming apparatus, and as a stand-alone apparatus that applies adhesive to a side edge (a back side) of printed sheets stacked in a bundle to form a booklet by binding that to a separately conveyed cover sheet. Such bookmaking apparatuses are also used as a system apparatus linked to a discharge outlet of an image forming apparatus to form a booklet by sequentially receiving printed sheets conveyed therefrom.

For example, Japanese Patent Publication No. 2004-209869 discloses a system that automatically finishes a booklet of sheets output from an image forming. Sheets outputted from an image forming apparatus are received from a discharge outlet and are guided to the discharge path and are stacked in a tray provided at a downstream side of the discharge path. The sheet bundle stacked on the tray in a substantially horizontal posture is then turned 90 degrees and guided to an adhesive application apparatus in a vertical posture for the application of adhesive. The above publication further discloses an apparatus that folds a sheet bundle applied with adhesive together with a cover sheet supplied from an inserter provided at a discharge path.

The above publication further discloses a gripping means that applies adhesive to a sheet bundle held in a vertical posture, a container holding adhesive, and a roller arranged in the container. The roller, covered with adhesive, travels along the side edge of the sheets applying adhesive to the bottom edge of the sheets.

In both the stand-alone apparatus and the system apparatus, a thermo-fusion type (hot-melt) adhesive is used. Being in a solid form until it is placed in the container, the adhesive is easy to handle. After it is placed in the container, it melts into a liquid form for application to the sheet bundle. After application, it hardens and becomes fixed to the sheet bundle. The adhesive is selected based upon its ability to harden and become affixed to the sheet bundle after an appropriate amount of time.

Furthermore, in order to prevent sheets from coming loose, the adhesive must harden and become affixed to the sheet bundle after a comparatively short amount of time and that the adhesive is applied without blotches so the sheet bundle and cover sheet are bound together.

Serious problems may occur when sequentially conveyed sheets are collected in a bundle shape, applied with adhesive on an edge thereof, and bound to a cover sheet. In bookmaking systems as disclosed by the above publication, the apparatus stops after dispensing adhesive or while dispensing adhesive while the cover sheet is conveyed to the binding position downstream of the adhesive application position. When the apparatus is stopped, the adhesive may harden and loses its adhesiveness. If a malfunction occurs, such as a paper jam in the process to convey the cover sheet, the apparatus will stop and the cover sheet must be removed and as a result, the sheet bundle that has been applied or is being applied with adhesive may be destroyed. In addition, the apparatus at an upstream side, such as the image forming apparatus must then be reset and the process must be restarted from the image forming stage. This kind of trouble invites complex recovery work, and is recognized as a major detriment to productivity and ease-of-use.

Also, any adhesive applied to the sheet bundle is required to have the proper viscosity to enter between individual sheets of the sheet bundle and not to drip while the sheet itself is conveyed from the image forming apparatus while being exposed to heat. When an image forming apparatus increases its speed to print at high speed the fixing temperature must be increased and the sheet is conveyed while being exposed to high heat levels.

Adhesive applied to the sheet does not harden at a predetermined point and may drip because of the vibrations of the machine. This dripping may cause a problem of adhesive being left in the machine. If the viscosity of adhesive is lowered to minimize the dripping, the pages will not be properly coated and may result in pages falling out. Conversely, if the viscosity is too high, the adhesive will drip and may result in the adhesive sticking to the cover sheet, ruining the esthetic appearance of the booklet. Because it is not possible to control the heat that the sheet itself is exposed to, the dripping of adhesive has been accepted as a necessary evil.

An object of the present invention is to provide a bookmaking apparatus that does not leave a sheet bundle applied with adhesive in the apparatus when conveyance trouble, such as a cover sheet paper jam, occurs; does not leave a cover sheet in the apparatus even if adhesive from a heated sheet bundle drips; and does not soil the cover sheet.

Another object is to provide an image forming system that can continuously perform the covering process without damaging the sheet bundle applied with adhesive even if cover sheet conveyance problems occur.

SUMMARY OF THE INVENTION

A first aspect of the present invention comprises sheet holding means for holding a sheet bundle at a predetermined adhesive application position, adhesive application means for applying adhesive to a sheet bundle of the adhesive application position, and cover sheet conveyance means for conveying a cover sheet to a binding position arranged at a downstream side of the adhesive application position. The adhesive application means applies adhesive to a sheet bundle after a cover sheet is set at the binding position by the cover sheet conveyance means. Therefore, because the cover sheet is already conveyed and set at a binding position downstream of the adhesive application means when adhesive is applied to a bottom edge of a sheet bundle, it is not necessary to remove the sheet bundle from the apparatus without leaving the sheet bundle applied with adhesive in the apparatus in the event of a conveyance malfunction, such as a paper jam in the process of conveying a cover sheet.

A second aspect of the present invention includes sheet holding means that comprises gripping conveyance means for holding the sheet bundle in a substantially vertical posture at the adhesive application position and for conveying the sheet bundle in a substantial vertical direction. Also, a cover sheet conveyance means is configured to convey and set a cover sheet from a predetermined feeding position to the binding position in a substantially horizontal direction. Because a cover sheet is already set at a downstream side, any dripping adhesive will not soil the cover sheet even if the adhesive is applied to a sheet bundle at a substantially vertical posture.

In a third aspect of the present invention, adhesive application means are composed of an applicator roll for applying adhesive to an edge of the sheet bundle, and drive means for moving the applicator roll from one edge to another edge of the sheet bundle. The cover sheet conveyance means is composed of conveyance roller means for conveying a cover sheet from a predetermined feeding position to the binding position, and the drive means is equipped with control means for starting movement of the applicator roll from one edge of the sheet bundle to the other when the cover sheet is conveyed and set at the binding position by the conveyance roller.

A fourth aspect of the invention includes an applicator roll configured to move between a moving position in order to apply adhesive from one edge of the sheet bundle to the other edge, and an idling position retracted from the moving position. A control means controls the drive means for moving the applicator roll from the idling position to the moving position after the cover sheet conveyance means sets the cover sheet at the binding position. Therefore, even if conveyance trouble, such as a paper jam, occurs in the process of feeding the cover sheet, the adhesive application member is moved from the moving position to the separated idling position, protecting the operator from being burned.

According to a fifth aspect of the present invention, operator safety is further enhanced by having the idling position set outside of the conveyance region of the cover sheet in a direction orthogonal to conveyance of the cover sheet.

A sixth aspect of the present invention includes a conveyance guide for guiding the cover sheet between the adhesive application position and the binding position. The conveyance guide is provided with an opening and closing guide plate to expose the adhesive application position. Furthermore, opening and closing means are provided on the guide plate when applying adhesive using the adhesive application means. Even if adhesive applied to the sheet bundle drips, the binding surface of the cover sheet is positioned at a downstream side and catches the drips, allowing a joining operation to continue thereabove, joining the sheet bundle without soiling the cover sheet.

A seventh aspect includes a stacking tray for stacking sequentially conveyed sheets in a substantially horizontal posture, sheet holding means for holding sheets from the stacking tray at predetermined adhesive application position deviated to a substantially vertical posture, adhesive application means for applying adhesive to a sheet bundle held by the sheet holding means, and cover sheet conveyance means arranged horizontally in a conveyance path for setting a conveyed cover sheet at a binding position positioned at a downstream side of the adhesive application position. The adhesive application means has an applicator roll for applying adhesive to an edge of a sheet of the adhesive application position, and the applicator roll applies adhesive to a sheet bundle after a cover sheet is set at the binding position by the cover sheet conveyance means.

In this way, sheets horizontally positioned are applied with adhesive in a vertical posture may be bound to a cover sheet conveyed in a horizontal direction in a more compact manner.

An eighth aspect of the present invention includes an image forming apparatus for forming images on a sheet, a stacking tray for stacking sheets from the image forming apparatus to form a bundle, sheet holding means for holding the sheet bundle from the stacking tray at a predetermined adhesive application position, adhesive application means for applying adhesive to a sheet bundle at the adhesive application position, cover sheet conveyance means for conveying a cover sheet to a binding position arranged at a downstream side of the adhesive application position, and joining means for joining an edge of a sheet bundle applied with adhesive by the adhesive application means and a cover sheet set at a binding position by the cover sheet conveyance means.

The adhesive application means applies adhesive to a sheet bundle after a cover sheet is set at the binding position by the cover sheet conveyance means. The image forming apparatus sequentially performs the predetermined printing and the printed sheet is automatically covered by the cover sheet. Another aspect of the present invention allows a cover sheet of a predetermined size to be conveyed from the image forming apparatus, or a cover sheet may be conveyed from a different inserter apparatus.

The cover sheet conveyance means conveys and sets a cover sheet at a binding position downstream of an adhesive application position before the adhesive application means applies adhesive to a sheet bundle held at the predetermined adhesive application position by the sheet holding means. Because adhesive has not yet been applied to the sheet bundle while the cover sheet is being conveyed, it is possible to convey a cover sheet and continue binding even if trouble such as a cover sheet jam occurs, without concern for the adhesive hardening.

Furthermore, with the present invention connected to an image forming apparatus at an upstream side of the bookmaking apparatus, there is no problem of sheets applied with adhesive being left in the bookmaking apparatus, even if trouble such as a paper jam or printing mistake should occur when conveying a sheet to the bookmaking apparatus, when the cover sheet printing is done by the image forming apparatus.

Similarly, when conveying the cover sheet from the inserter apparatus, the sheets applied with adhesive are not left in the apparatus even if trouble, such as when the predetermined cover sheet has not been prepared, or when a paper jam has occurred. Furthermore, because the cover sheet is conveyed and set at the binding position at a downstream side of the adhesive application position at a time when the adhesive application means starts applying adhesive to the sheet bundle, even if adhesive applied to the sheet bundle drips, the adhesive drips onto the backside (the binding portion) of the cover sheet so it does not remain in the apparatus, and the cover sheet is not soiled.

DETAILED DESCRIPTION OF PREFERRED EMBODIMENTS

Figure 1:
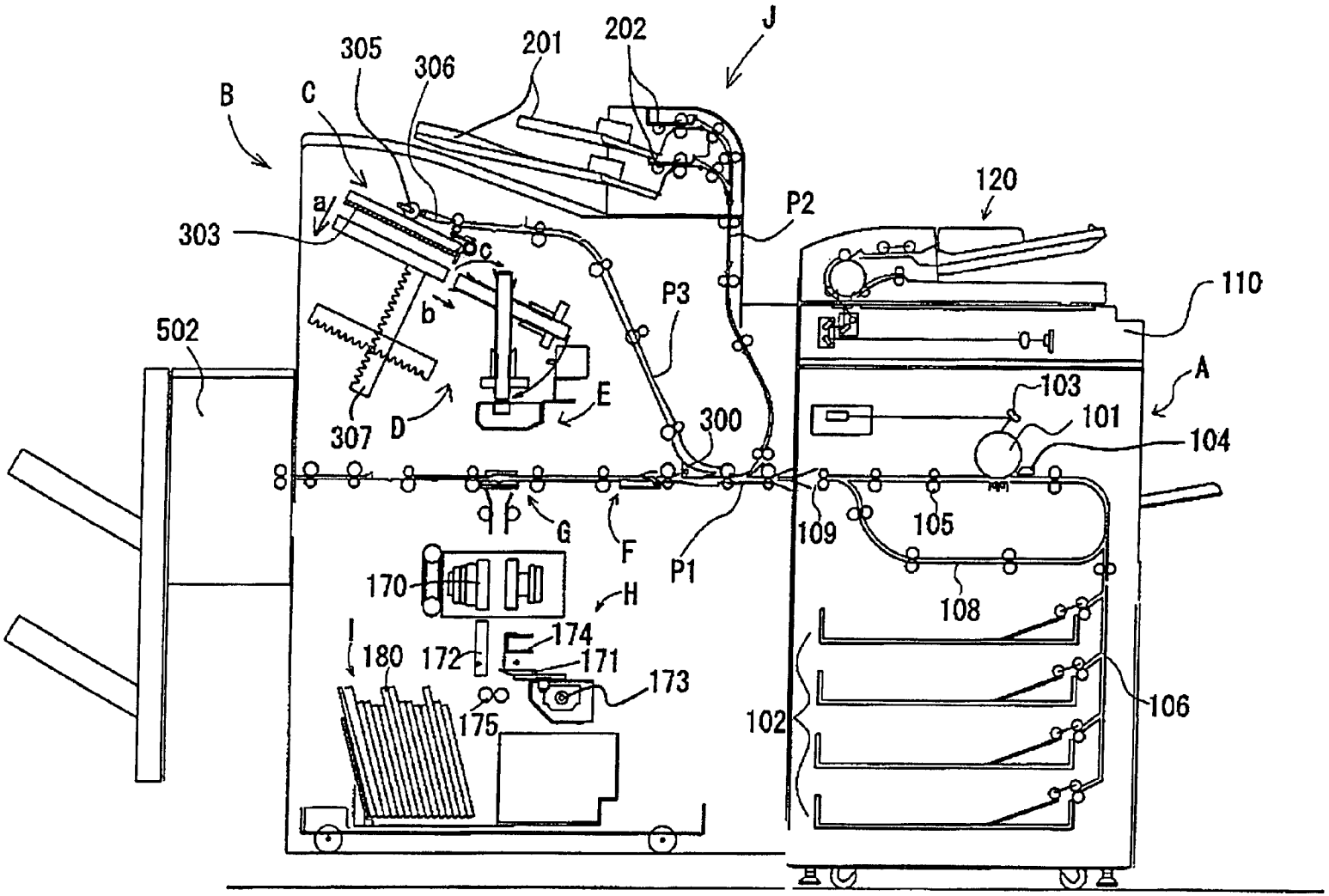
FIG. 1 is an elevation view of the overall structure of the image forming system according to the present invention.
Figure 2:
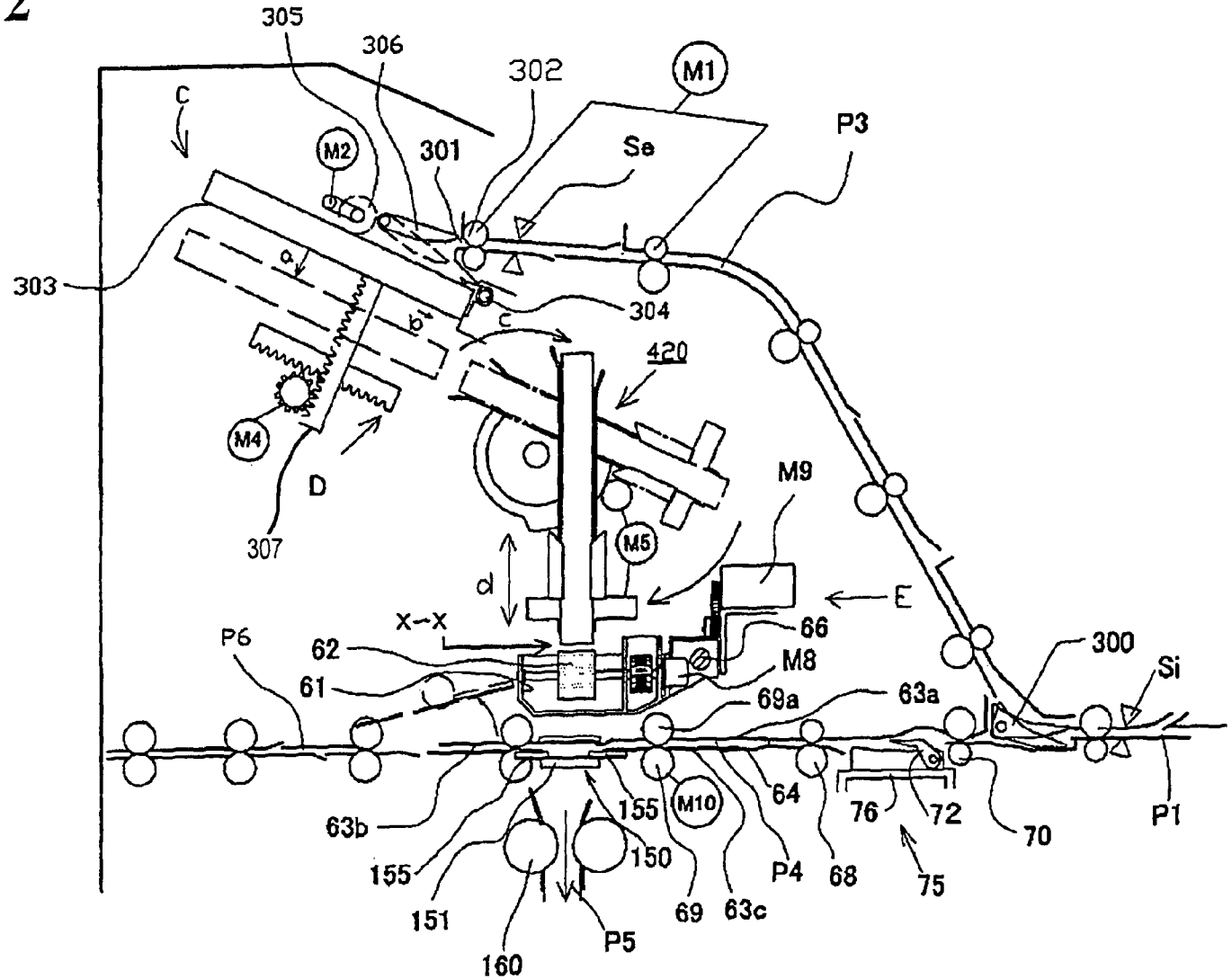
FIG. 2 is a detailed view of one portion of the apparatus of FIG. 1.

A bookmaking apparatus shown in the drawings and an image forming system that includes the same will be explained below with reference to the drawings provided. FIG. 1 is an elevation view of an image forming system. FIG. 2 is a detailed view of a portion of the image forming system. The image forming system shown in FIG. 1 comprises an image forming apparatus A that sequentially prints images to sheets, a bookmaking apparatus B that stacks a series of sheets from the image forming apparatus A in a bundle and binds them to a cover sheet to form a booklet, and an inserter J that supplies cover sheets to the bookmaking apparatus B.

Image Forming Apparatus

A series of documents from a system such as a computer or word processor is printed on surfaces of sheets and is discharged from a discharge outlet 109. Non-limiting, the image forming apparatus A may comprise any printing means, such as a laser printer or ink jet printer. The printing means shown in the drawing of the embodiment does not have any particular feature or characteristic. Therefore, any known printer configuration or image forming apparatus configuration may be easily applied in conjunction with the present invention. An example of an image forming apparatus will be explained with reference to FIG. 1.

An image forming apparatus A may comprise a printing drum 101 such as an electrostatic drum; a sheet feeder cassette 102 that feeds sheets to the printing drum 101; a print head 103, such as a laser, that forms an image on the printing drum 101; a developer 104; and a fixer 105. Sheets are fed from the sheet feeder cassette 102 to a sheet feeding path 106. The printing drum 101 is arranged on the sheet feeding path 106. A latent image is formed on the printing drum 101 and toner ink is affixed thereto by the developer 104. The toner image formed on the printing drum 101 is transferred to a surface of the sheet and fixed thereto by the fixer 105. The sheet is then discharged from the discharge outlet 109.

A turn-over path 108 comprises a duplex path for printing to a back surface of a sheet operable by turning over the sheet printed with an image, from front to back and guiding it again to the printing drum 101.

Image forming apparatus A may comprise an ordinary scanner apparatus 110, having a platen (made of glass or other transparent material) for setting the original, a reciprocating scanning carriage that travels under and along the length of the platen, and photoelectric conversion elements. An original document feeding apparatus 120 automatically supplies originals set in a stacker by an operator, to the platen top. The original feeding apparatus 120 sequentially supplies the originals one at a time to a reading unit where the original image is photo-electrically converted and supplied to a data storage unit on the print head 103. An external device such as a computer or word processor containing an electronic representation of the original may be connected to the data storage unit which may receive the electronic data from these external devices. Although the image forming apparatus A may comprise a laser printer, the invention is by no means limited thereto and can easily employ any type of printing method such as an ink jet printer, silk screen printing or offset printing.

Bookmaking Apparatus

The bookmaking apparatus B comprises a stacking tray unit C that sequentially stacks sheets in up and down directions in page order. The sheets are outputted from a discharge outlet 109 on the image forming apparatus A and are aligned into a bundle. Bookmaking apparatus B further comprises: a bundle conveyance unit D that conveys and sets a sheet bundle stacked and aligned into a bundle to an adhesive application position; an adhesive application unit E that applies adhesive to one edge of the sheet bundle; a cover sheet conveyance unit F arranged at a downstream side of the adhesive application position, that feeds and sets a cover sheet at a binding position; a binding unit G that joins the cover sheet and the sheet bundle applied with adhesive; a cutting unit H that cuts the edge of the bound sheet bundle at a predetermined amount; and a storage stacker unit 1 that stores a sheet bundle that is finished into a booklet. The configuration of each of the above units C through H will be described below.

Stacking Tray Unit

Referring now to the detailed drawing of FIG. 2, a sheet conveyance path P1 is linked to the discharge outlet 109 of the image forming apparatus A described above. This sheet conveyance path P1 traverses substantially the center of the apparatus and is arranged in a substantially horizontally direction. A sheet feeding path P2 of the inserter J is connected to an inlet edge of the sheet conveyance path P1. A discharge path P3 is linked via a path switching piece 300 and is arranged to branch off and guide a sheet in an upper direction from the sheet conveyance path P1 that traverses substantially the center of the apparatus. A sheet conveyance means, i.e., discharge rollers 302, and a sheet sensor Se are arranged at a discharge outlet 301.

A stacking tray 303 forming a step is obliquely arranged at a downstream side of the discharge outlet 301 in a substantially horizontal direction in the drawings. A trailing edge aligning member 304 that aligns a trailing edge (in the direction of sheet conveyance) of the sheet, an aligning roller 305, and a sheet guide 306 are arranged at the stacking tray 303.

The aligning roller 305 is linked to a drive motor M2 that is capable of both in a forward and reverse direction. When the sheet is discharged from the discharge outlet 301, drive motor M2 rotates in a discharge direction (a clockwise direction). After the trailing edge of the sheet advances into the stacking tray 303, the drive motor M2 rotates in an opposite direction (a counterclockwise direction) to engage and align the trailing edge of the sheet against a trailing edge aligning member 304. A sheet guide 306 is linked to drive means, such as an operating solenoid, not shown, to guide a sheet from the discharge outlet 301 to the top of the stacking tray 303, where the guide 306 swings freely to guide a sheet along the stacking tray 303 to the trailing edge aligning member 304, after the sheet is conveyed.

Aligning means, not shown, are provided on the stacking tray 303 to align left and right sides in the width direction of a sheet, or alternatively, to align a sheet at a center reference. The aligning means are arranged to move a pair of aligning plates (for example on the left and right sides) in a width direction over a tray. At least one of the aligning plates is moved by a drive motor in a reciprocating manner, to align sheets at a predetermined reference position.

Of particular note, when referring to FIG. 2, the stacking tray 303 is movably supported on the apparatus frame to move in up and down directions. The stacked sheets are thus moved in the direction of the arrow "a", and then moved in the direction of the arrow "b" to be conveyed to the gripping conveyance means 420 (hereinafter referred to as sheet holding means). Next, the stacking tray 303 may engage a guide rail, disposed for example, on an apparatus frame, to freely rise and descend, by a predetermined amount, between a stacking position for stacking sheets, and a lowered position at a bottom side. A pinion linked to the drive motor M4 and a rack 307 engaging the pinion are fastened to the tray side. This enables the stacking tray 303 to be raised and lowered by the drive motor M4 between the stacking position and the lowered position.

Bundle Conveyance Unit

Still referring to FIG. 2, the bundle conveyance unit D conveys the sheet bundle from the stacking position to a lowered position, after moving the stacking tray 303 a predetermined distance therebelow.

Bundle conveyance unit D comprises gripping conveyance means 420. The sheet bundle, received from the stacking tray 303 in a substantially horizontal posture, is turned approximately 90 degrees to be oriented substantially vertically and is sent to an adhesive application position (X-X). For that reason, gripping conveyance means 420 is configured by embedding dampers 421 and 422 into a unit frame that is rotatably supported on a shaft 424 on the apparatus frame, as shown in FIG. 3.

Figure 3:
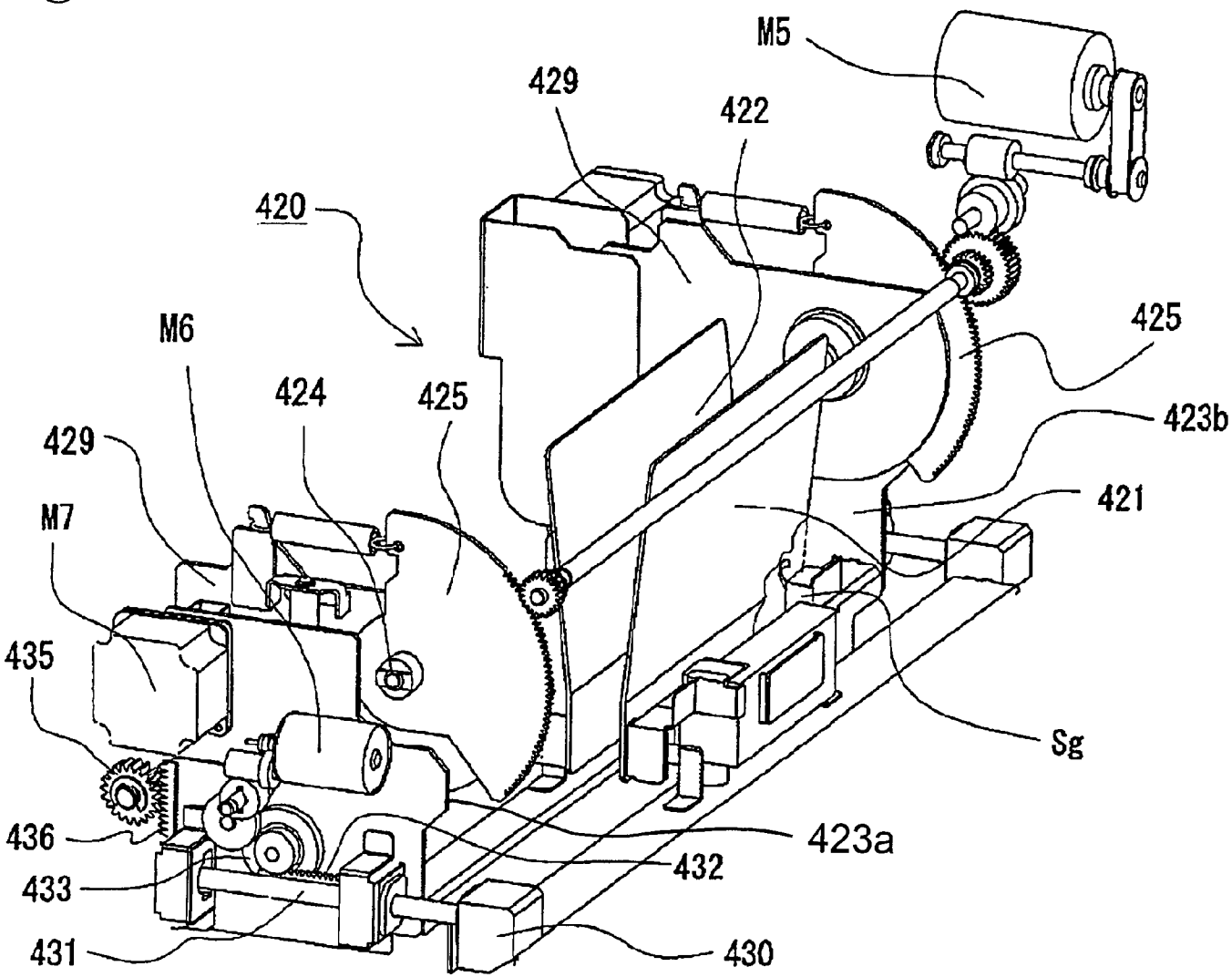
FIG. 3 is a perspective view of sheet holding means according to the apparatus of FIG. 1.

Still referring to FIG. 3, a fan-shaped gear 425 is mounted to the unit frame 429. By rotating the fan-shaped gear 425 with a turning motor M5 mounted on the apparatus frame, the fan-shaped gear 425 rotates a predetermined amount around the shaft 424. The pair of dampers on the unit frame 429 is composed of the movable damper 421 and the fixed damper 422 for gripping a sheet bundle fed from the stacking tray 303.

Right and left side frames 423*a* and 423*b* are risibly mounted to the unit frame 429 by a guide rail, not shown. The fixed clamper 422 is fastened to the right and left side frames 423*a* and 423*b*. The movable clamper 421 is fastened to the rod 431 that engages moveable clamper attachment block 430. The rack 432 is provided on the rod 431, and a pinion 433 linked to a drive motor M6 meshes with the rack 432. Therefore, by driving the drive motor M6, the movable clamper 421 moves in a left and right direction of FIG. 3. The side frames 423*a* and 423*b* mounted with these clampers 421 and 422 move rack 436, mounted to a side frame, in up and down direction of FIG. 3, via the pinion 435 using a rising and lowering motor M7 mounted to the unit frame 429. Non-limiting, rising and lowering motor M7 may comprise a stepping motor, for example. The positions of the fixed clamper 422 and movable clamper 421 supported by the left and right side frames 423*a* and 423*b* are controlled in up and down directions of FIG. 2 (see arrow d) by controlling the supply of electrical pulses.

Therefore, the movable damper 421 sandwiches and releases a sheet bundle between the fixed damper 422 by the drive from the drive motor M6. Both dampers move in reciprocating directions, indicated by arrow "d" of FIG. 2, by the rising and lowering motor M7. The gripping conveyance means 420 comprising both dampers configure sheet holding means that grip and convey sheets to the adhesive application position where adhesive is applied to the sheet bundle.

Still referring to FIG. 3, a gripping sensor Sg is provided at the movable damper 421 for detecting the status of contact with the sheet bundle. A detecting sensor Sa (not shown) is provided at the rod 431 of the movable damper 421 for detecting sheet bundle thickness. The sheet bundle thickness sensor Sa detects a gap between the fixed damper 422 and the movable damper 421 using, for example, a slider sensor. Therefore, it is possible to detect sheet bundle thickness from the status of the sheet bundle thickness sensor Sa (for example a resistance value), using the signal from the sensor Sa when the gripping sensor Sg turns ON by touching the sheets.

The thickness detection mean that detects the thickness of a sheet bundle stacked on the stacking tray 303 is used for multiple purposes. For example: (1) the gap between the adhesive applicator roll, described below, and the sheet bundle is set to correspond to the thickness of the sheet bundle; (2) the setting position of the cover sheet is adjusted to correspond to the amount of feed for the cover sheet and the thickness of the sheet bundle, and the sheet bundle is set to match the center of the cover sheet; and (3) the starting position of the sheet cutting blade is adjusted to correspond to the sheet bundle thickness and is used in a finishing operation.

Thickness detection may employ a variety of thickness detection methods such as by counting the number of sheets using the sheet sensor Se of the discharge outlet 301 and by multiplying the number of sheets by the average thickness of a sheet.

As described above, the drive motor M6 drives the movable damper 421 in a direction to grip a sheet bundle, i.e., towards the fixed damper 422, and grips a sheet bundle. When engaged, the gripping sensor Sg turns ON and the drive motor M6 drives a predetermined amount after that receipt of the ON signal. This causes the movable damper 421 to further approach the fixed damper 422 to grip the sheet bundle, overcoming an urging spring, not shown, and then to stop. The sheet bundle thickness is detected from the output value of the sheet bundle thickness sensor Sa and the sheet bundle is securely held. At this time, the rising and lowering motor M7 drives the gripping conveyance means 420 and the gripped the sheet bundle to move in a downward direction "d" of FIG. 2, to an adhesive application position X-X.

Adhesive Application Unit

The adhesive application unit E is composed of a container 61 for holding adhesive arranged at the adhesive application position X-X; an applicator roll 62 rotatably installed in the container; a drive motor M8 for rotatingly driving the applicator roll 62; and a drive motor M9 for reciprocatingly driving the container along the sheet bundle.

Figure 4:
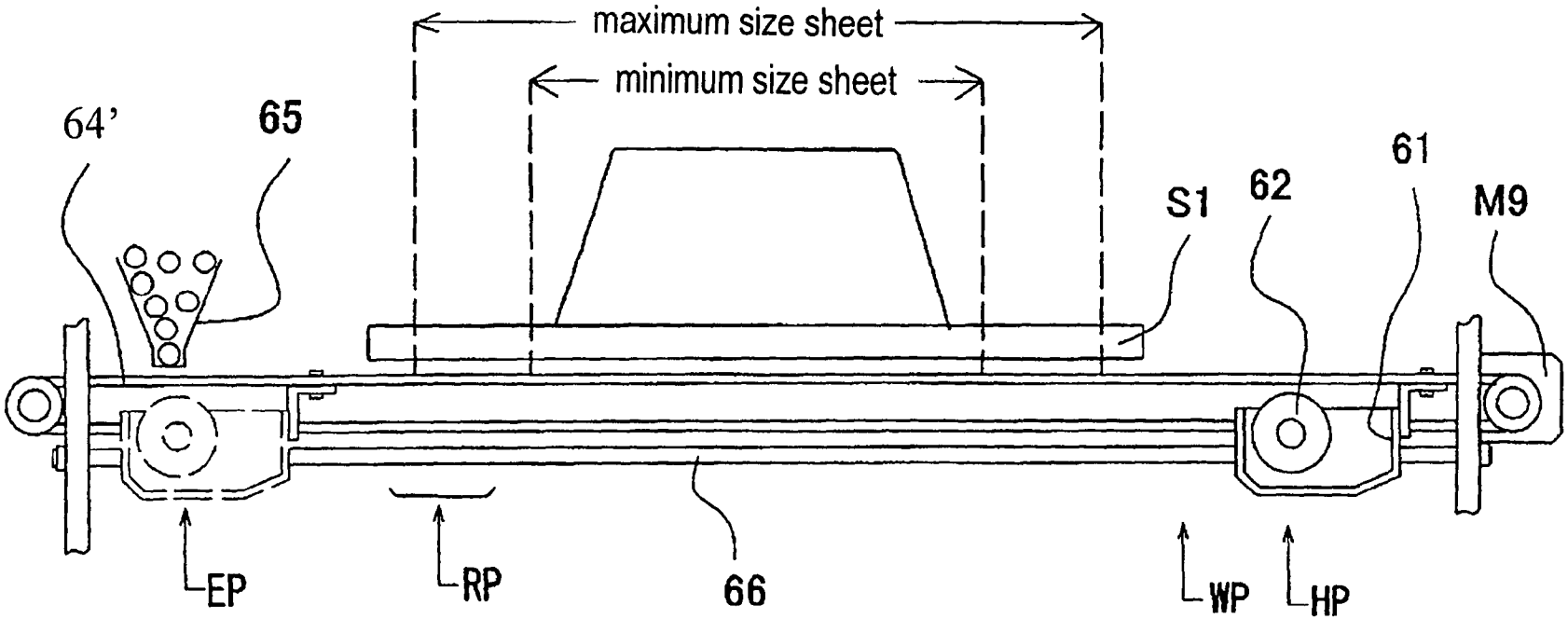
FIG. 4 is a side view of adhesive application means according to the apparatus of FIG. 1.

FIG. 4 is a side view of the adhesive application unit E. The container 61 is formed to a shorter length than the bottom side edge of the sheet bundle S1. The container 61 is supported on a guide rail 66 mounted to the apparatus frame in order to move along a bottom side edge of the sheet bundle S1 along with the applicator roll 62 mounted thereto. The container 61, supported by the guide rail 66, is fastened to a timing belt 64' mounted to the apparatus frame along the guide rail 66. A drive motor M9 is linked to this timing belt 64'.

In one aspect, the container 61 is shorter than the length of the sheet bundle, and is configured to move down the length of the sheets parallel to a width of the sheets. However, in another embodiment and still referring to FIG. 4, a container 61 may comprise a tray that is larger than the length of the sheet bundle bottom side edge S1 and the applicator roll 62 moves in left and right directions. FIG. 4 shows the applicator roll 62 composed of an adhesive applicator member that applies adhesive to the sheet bundle. The roll 62 may be made of a porous and heat resistant material and is formed so that when covered with adhesive, the adhesive will form a thick layer on the circumference of the roll 62.

The container 61 reciprocatingly moves between its home position HP, an idling position WP, from where it starts its outward movement along the bottom edge of the sheet bundle S1, a return position RP from where it starts its return movement along the bottom edge of the sheet bundle S1, and an idling position EP where adhesive is replenished. Movement to each of these positions is controlled by the drive motor M9. The relationships between each of the positions are set to the positional relationships shown in FIG. 4. When the apparatus power is turned ON an initializing operation sets the home position HP. Furthermore, upon receipt of a sheet gripping signal from the gripping sensor Sg of the gripping conveyance means 420, the container 61 moves from the home position HP to the idling position WP. At the same time as this movement, the drive motor M8 starts rotating the applicator roll 62.

Next, the container 61 begins moving along the guide rail 66 to the left side of FIG. 4 by applying an application instruction signal to the drive motor M9. When traveling from right to left in FIG. 4 (an outward movement), the applicator roll 62 touches the sheet bundle and separates the ends of the sheets. In the return movement (in the right direction of the drawing), a gap of a predetermined amount is formed from the applicator roll 62 to the sheet edges and adhesive is applied by an eccentric cam adjusting the positional relationship with the sheet bundle. Then, the drive motor M9 drives to move from one edge of the sheet bundle (right edge in the drawing) to another edge (left edge of the drawing) with size information of the sheets.

The return movement is controlled at the return position RP. When the drive motor M9 moves the container 61 from the operating position where adhesive is applied to the sheet bundle to the idling position EP separated from that position for idling at the idling instruction signal, adhesive is replenished to the container from an adhesive tank 65 arranged at the idling position EP.

Inserter Apparatus

A cover sheet is bound to the sheet bundle applied with adhesive at the adhesive application unit E. The feeding of a cover sheet will be explained below. Sheets formed with images are sequentially conveyed to the discharge outlet 109 (FIG. 1) of the image forming apparatus A. Normally, a discharge sheet stacker is prepared at the discharge outlet 109. However, according to the present invention, the sheet conveyance path P1 is linked to the discharge outlet 109 as the bookmaking apparatus B, and an inserter J is installed at this sheet conveyance path P1.

The inserter J comprises one or a plurality of stacking trays 201 for stacking sheets (FIG. 1 shows two tiers of stacking trays 201), pickup means 202 for separating sheets on the stacking tray 201 into single sheets, and a sheet feeding path P2 for guiding a sheet from the pickup means 202 to the sheet conveyance path P1.

Sheets set on the stacking tray 201 are fed to the sheet conveyance path P1 in between sheets sequentially conveyed from the discharge outlet 109 of the image forming apparatus A. In other words, after a series of sheets are formed with images and are conveyed from the image forming apparatus A, sheets are fed from the stacking tray 201 after the final sheet of the series of sheets is fed from the image forming apparatus A.

Special sheets, i.e., thick or coated sheets, are prepared as cover sheets in the stacking tray 201. A sheet on the stacking tray 201 is conveyed to the sheet conveyance path P1 upon receipt of a control signal sent from the bookmaking apparatus B. A two-tiered approach to the stacking trays 201 allows for the preparation of different types of cover sheets in advance on the trays, permitting the operator to select the type of cover sheet to bind to the sheet bundle by selecting a specific tray.

Referring to FIG. 1, the bookbinding process comprises conveying the sheet from the image forming apparatus A toward the stacking tray unit C, as described below. The inserter J supplies the cover sheet to the discharge path. For this reason, a hopper for feeding cover sheets is provided along with separating means for separating sheets from the hopper into single sheets. In addition, a conveyance mechanism for conveying a sheet to the discharge path is provided. Note that the embodiments shown in the drawings indicate no particular configuration. Non-limiting, any known inserter mechanism may be employed and still be within the spirit of the present invention.

Cover Sheet Conveyance Unit

In the system of FIG. 1, a sheet feeding path P2 of the inserter J is linked and the discharge path P3 of the stacking tray unit C is connected, to the sheet conveyance path P1. FIG. 2 discloses a cover sheet conveyance path P4 is linked to the sheet conveyance path P1 via a path switching piece 300, and a cover sheet from the inserter J is guided to the cover sheet conveyance path P4. This cover sheet conveyance path P4 orthogonally intersects a bookmaking path P5 such that sheet bundle and cover sheet substantially form a shape of a "T" when joined.

Still referring to FIG. 2, the cover sheet conveyance path P4 is composed of upper conveyance guides 63*a* and 63*b*, and a lower conveyance guide 63*c*, the lower conveyance guide 63*c* opposing guide 66*a* at a predetermined gap. The upper conveyance guides 63*a* and 63*b* are separated into a first upper conveyance guide 63*a* on the right side, and a second upper conveyance guide 63*b* using the bookmaking path P5 as a boundary. The right and left conveyance guides 63*a* and 63*b* individually open and close. A binding position 150 is formed as an intersecting space at an intersection of the bookmaking path P5 and the cover sheet conveyance path P4. The sheet bundle and cover sheet are jointed into a substantial upside-down T-shape at this position.

Registration means are arranged on the cover sheet conveyance path P4 for positioning the cover sheet at each position of the conveyance direction and of the conveyance right angle direction. Cover sheet conveyance means are provided for conveying a cover sheet positioned by the registration means at the binding position 150 and comprises driver roller 69 mounted on the lower conveyance guide 63*c*, and follower roller 69*a* mounted on the upper conveyance guides 63*a* and 63*b*. A drive motor 10 is linked to the drive roller 69. The upper conveyance guides 63*a* and 63*b* and the follower roller 69*a* are mounted to the apparatus frame by a cam lever, for example, that is capable of moving between a position that touches the driver roller 69 and a separated position rising thereabove.

Therefore, the upper conveyance guides 63*a* and 63*b* and the follower roller 69*a* are structured to move between an operating position where they touch a cover sheet in the path by the drive motor of the cam lever, not shown, and move the cover sheet to the left side of FIG. 2, and a retracted position that rises separated from the cover sheet.

Figure 5:
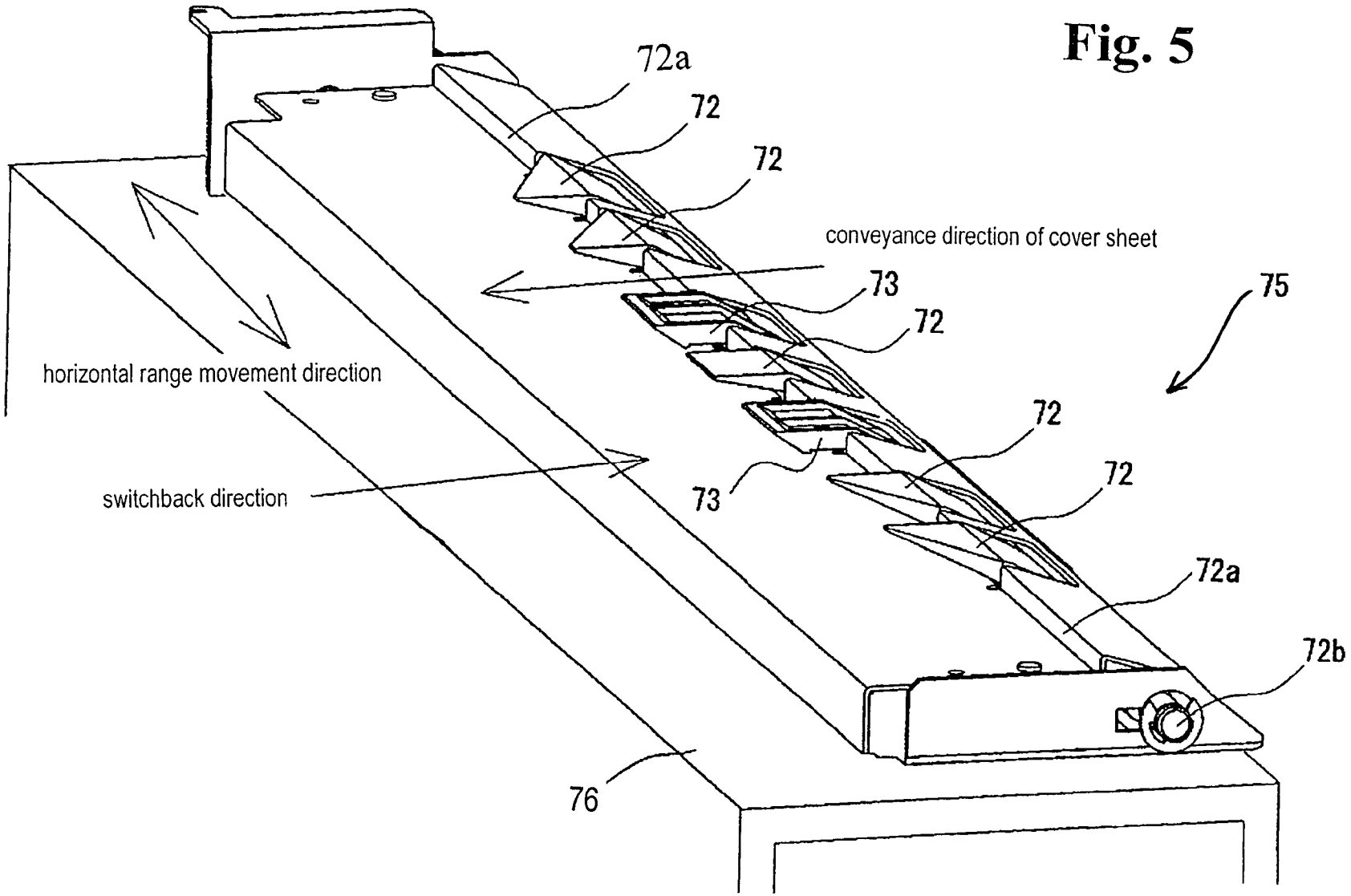
FIG. 5 is a top perspective view of an aligning unit of the cover sheet conveyance path according to the apparatus of FIG. 1.

The aligning unit, illustrated in FIG. 2 as being provided in the path of P1 and P4, is described in detail in FIG. 5. The aligning unit 75 is composed of stopper steps 72*a* and nipping claw members 72 that nip a cover sheet and have a positional relationship in the drawing with the conveyance direction of the cover sheet. An upper paper guide (not shown) is fixedly mounted. This aligning unit 75 is mounted so as to be moveably in a left and right direction (a horizontal range movement) in the drawing on the fixed frame 76. That is, a guide rail, not shown, is provided on the fixed frame 76, and the aligning unit 75 is movably mated to this guide rail. A stepping motor, not shown, capable of both forward and reverse drives, is provided on the fixed frame 76 and is linked to the aligning unit 75. Therefore, by driving this stepping motor, the aligning unit 75 moves in the left and right directions when viewing FIG. 5.

Still referring to FIG. 5, there is a plurality of nipping claw members 72 that are configured to rotate by operation of a shaft 72*b*. At the position shown in the drawing, they nip and hold a cover sheet, and when the shaft 72*b* rotates in a clockwise direction of the drawing, the nipping claw members 72 stand upright and engage a sheet edge along with a step wall 72*a*.

Drive means such as an operating solenoid (not shown) are linked to the shaft 72*b*. The nipping claw members 72 are arranged at the sheet conveyance path P1 (FIG. 1) and when an operating solenoid is off, they are placed in a laid-over posture to guide a cover sheet to the cover sheet conveyance path P4. Thereafter, when the operating solenoid turns on, the nipping claw members 72 shift to an upright posture to engage and stop a cover sheet that is switched back and fed in reverse.

Referring back to FIG. 2, a reverse rotating roller 68 is provided at a downstream side of the aligning unit 75 on the cover sheet conveyance path P4. The reverse rotating roller 68 is mounted on a swingable support arm, and is arranged to rise and lower between a position where it engages the cover sheet, and a retracted position where it does not engage the cover sheet. A drive motor, not shown, is linked to the reverse rotating roller 68 in order to feed the cover sheet in a direction opposite to the feed direction.

As shown in FIG. 2, at least one conveyance roller 69 is arranged on the cover sheet conveyance path P4 on the first upper conveyance guide 63*a*. A conveyance roller (inlet roller) 70 is arranged at an upstream side of the aligning unit 75. Conveyance roller 69 as part of cover sheet conveyance means, conveys a sheet, aligned by the aligning unit 75, a predetermined amount.

A sensor Si (not shown) detects the leading edge of the cover sheet advancing into the cover sheet conveyance path P4 at which point the cover sheet is conveyed by the conveyance roller (inlet roller) 70 and conveyance roller 69. The nipping claw members 72 of the aligning unit 75 are then laid over to allow the cover sheet to proceed through and the reverse rotating roller 68 is set retracted upward from the path. After a predetermined delay time allowing for the leading edge of the sheet to pass the aligning unit 75, upon a signal from the sensor Si, the conveyance roller (inlet roller 70) and conveyance roller 69 retract from the sheet. The reverse rotating roller 68 is then lowered to a position where it engages the sheet, and at the same time, all conveyance rollers that are engaging the sheet retract upward away from the sheet.

The reverse rotation roller 68 then operates to move the sheet in a direct opposite to the conveyance direction. At this time, the nipping claw members 72 are positioned upright by the operating solenoid. When this occurs, the trailing edge of the sheet abuts the nipping claw members 72. Immediately thereafter, the reverse rotating roller 68 stops and separates from the sheet. Note that the timing to stop the reverse rotating roller 68 is calculated based upon a signal that the sensor Si has detected the trailing edge of the sheet.

The power to the operating solenoid is then cut and the nipping claw members 72 return to their original state. At this time, the trailing edge of the sheet is nipped by the stepped portion (plates) 73 of the aligning unit 75 and the nipping claw members 72. In this state, when the aligning unit 75 moves in a direction that is orthogonal to the conveyance direction, the sheet nipped by the nipping claw members 72 moves at the same time.

A plurality of sensors is arranged in a direction orthogonal to the direction of sheet conveyance on the fixed frame 76 that movably supports the aligning unit 75. These sensors determine the position of the horizontal direction of the sheet. After determining (aligning) the position of the orthogonal direction of sheet conveyance, the conveyance rollers 69 and 70 lower to a position where they engage the sheet. All conveyance rollers then engage the sheet and the reverse rotating roller 68 is set at a position retracted from the sheet. The operating solenoid then turns on again, rotating the stoppers to an upright position. At this point, the conveyance roller 69 rotates, conveying the sheet to a downstream side of the cover sheet conveyance path P4, and the nipping claw members 72 recover to their initial, laid-over posture.

Still referring to FIG. 2, the conveyance roller 69 is linked to the drive motor 10, and is controlled by a control CPU. An aligning operation aligns a cover sheet positioned by the nipping claw members 72 in a direction that is orthogonal to the conveyance direction. The conveyance rollers 69 then convey the cover sheet a predetermined amount toward the binding position 150.

To control the conveyance roller 69, the control CPU calculates the conveyance amount to match the center of the sheet to the binding position center based upon the length of the cover sheet (in the conveyance direction), and the thickness of the sheet bundle conveyed from the bookmaking path P5. Based on the calculations, the CPU determines the number of steps a drive motor, i.e., a stepping motor, must make, and therefore, the number of supply drive pulses to generate.

A method of determining the conveyance amount is then selected. The conveyance amount may be determined only from the sheet length, or may be calculated based upon the sheet length and a sheet bundle thickness determined from the sheet thickness detection sensor Sa.

Accordingly, the cover sheet is conveyed to the binding position 150, the intersection of the cover sheet conveyance path P4 and the bookmaking path P5, and is set at a predetermined position. The upper conveyance guides 63*a* and 63*b* of the binding position 150 are comprised of opening and closing guide plates. They are configured to move between a position for covering the bookmaking path P5 and guiding the top of the cover sheet, and a position retracted from the bookmaking path P5. After the conveyance guide 63*b* guides the cover sheet, guide 63*b* retracts to open the bookmaking path P5. The structure includes a cam lever attached to the apparatus frame, and the conveyance guide 63*b* is fastened to this lever. Furthermore, the structure may include swinging the lever using drive means such as a solenoid or motor.

Binding Unit

The binding position is formed at the intersection of the bookmaking path P5 and the cover sheet conveyance path P4, and at this position a joining means and a back folding block 155 that configure the backup member 151 are provided. More specifically, at this position, the sheet bundle conveyed from the bookmaking path P5, and the cover sheet conveyed from the cover sheet conveyance path P4, are joined in an upside-down T shape. First, adhesive is applied by the adhesive application unit E to a lower side edge of the sheet bundle gripped by the gripping conveyance means 420 at the bookmaking path P5. Concurrently, the cover sheet is set at the binding position 150 of the cover sheet conveyance path P4.

The sheet bundle is supported by the gripping conveyance means 420 and is fed to the binding position, at which time, the cover sheet is supported by the backup member 151 and the sheet bundle and the cover sheet are joined. In this state, the back-folding blocks 155 composed of a pair of blocks, left and right, move from positions separated from each other to press the backside of the sheet bundle, and together with the backup member 151 press form the backside in the bookmaking process.

The folding rollers 160 are provided on the bookmaking path P5 at a downstream side of the binding position 150. The pair of folding rollers are configured to contact and separate from each other. They contact each other by a pressure spring, and are separated by the operating solenoid. Then, the folding rollers 160 are separated to allow the sheet bundle joined to the cover sheet to be lowered to a downstream side along the bookmaking path P5 by the gripping conveyance means 420. A sensor detects the position of the sheet bundle and causes the folding rollers 160 to press together. Next, the dampers 421 and 422 release the sheet bundle, and rotate the folding rollers 160 in the conveyance direction to convey the sheet bundle out. With this conveyance out action, the sheet bundle and cover sheet are joined together into a booklet and are folded.

Cutting Unit

The booklet sheet bundle is fed by the folding rollers 160 to the cutting unit arranged at a downstream side of the binding position 150, and the edges of the sheets to be aligned are cut. A rotating table 170 (FIG. 1) is provided at the bookmaking path P5 downstream of the folding rollers 160 to grip and fold the sheet bundle. A cutting blade 171 and a blade rest block 172 are prepared downstream of the rotating table. A cutting motor 173 is linked to the cutting blade 171 and FIG. 1 shows the sheet cutting edge press member 174 that pressingly holds the cutting edges of the sheet. The sheet bundle fed to the bookmaking path P5 is grippingly held by the rotating table and is fed to the cutting position. At the cutting position, the sheet bundle is cut by the cutting blade 171 while being held by the cutting edge press member 174. In this way the sheet bundle bound at the backside with a cover sheet is cut at the top, sides and lower edge in order, then is stored in the storage stacker 180 by the discharge rollers 175.

Figure 6:
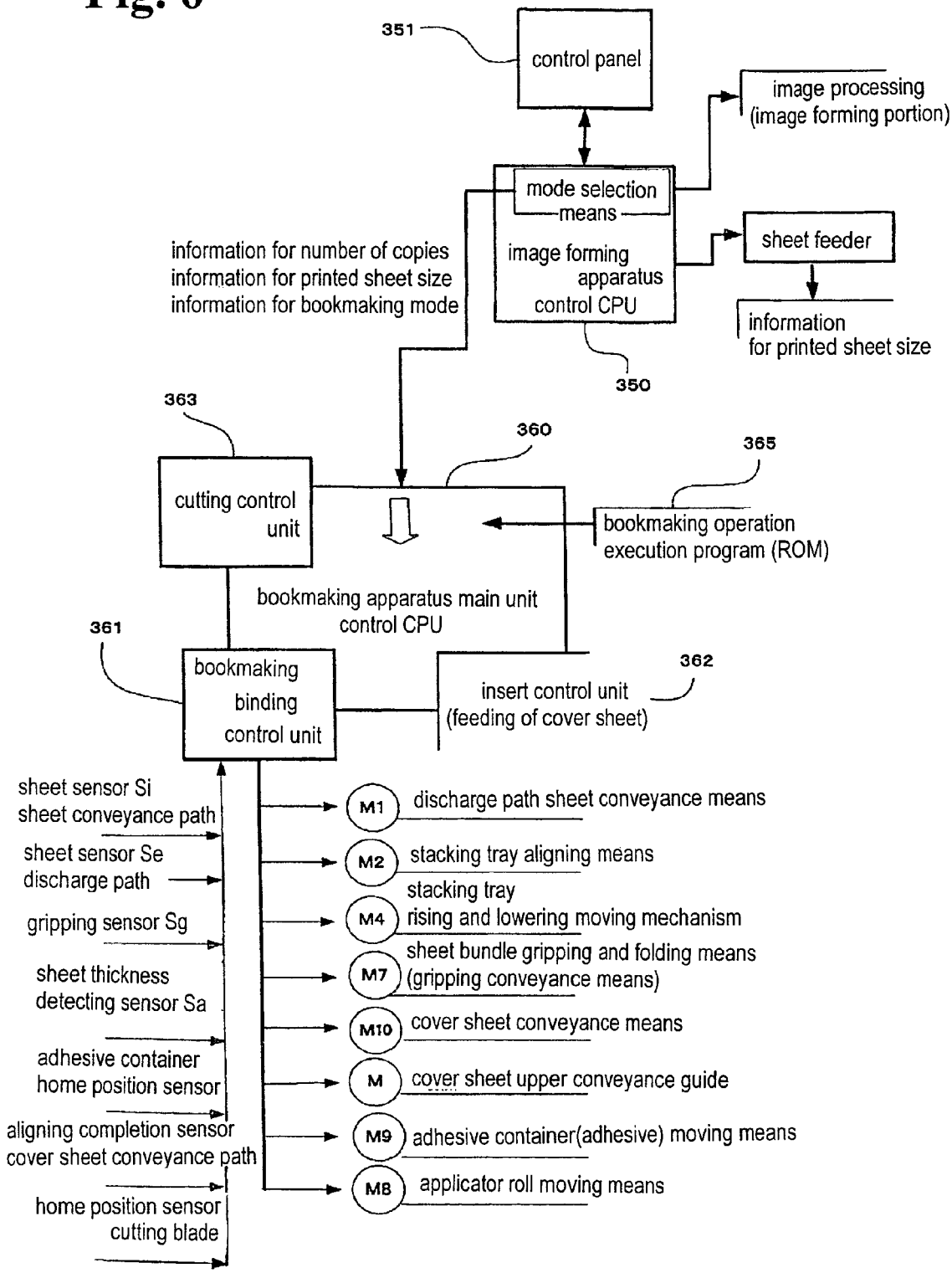
FIG. 6 is a block diagram of the control unit in the image forming system according to the apparatus of FIG. 1.

The following will explain the control of the apparatus described above. FIG. 6 is a block diagram showing the control of the system apparatus of FIG. 1. First, a control panel and mode selection means are provided on the image forming apparatus A. The control CPU 350 of the image forming apparatus A inputs the process selection of "printing process mode," "bookmaking process mode," and "bookmaking and cutting process mode" from the control panel 351. With the printing process mode selected, the path switching piece 300 conveys a printed sheet conveyed from the sheet conveyance path P1 to the finishing apparatus from the cover sheet conveyance path P4 and the discharge path P6 and stores it in the stacker 502 provided on the finishing apparatus. Therefore, the printed sheet passes through the bookmaking apparatus.

When the "bookmaking process mode" is selected, the bookmaking apparatus B guides the printed sheet from the sheet conveyance path P1 to the discharge path P3, and stores the sheet in the storing stacker 180 after collecting all sheets, applying adhesive and binding the sheet bundle to a cover sheet.

When the "bookmaking and cutting mode" is selected, the sheet bundle bound with the cover sheet is cut on the top, sides and lower edge by the cutting blade 171 and then the sheet bundle is stacked in the storing stacker 180. The backside which is the bound portion is not cut.

When the "bookmaking mode," or the "bookmaking and cutting mode" is selected, the control CPU 350 of the image forming apparatus A transmits an instruction signal indicating the operating mode and printed sheet size information to the bookmaking apparatus B. At the same time as this, information for the number of copies, for example when printing n pages, when the final nth page is ended, a job end signal is transferred to the control CPU 360 of the bookmaking apparatus B.

The control CPU 360 of the bookmaking apparatus is composed of bookmaking binding control unit 361, inserter control unit 362, and cutting control unit 363. Components linked to the bookmaking binding control unit 361 include: a conveyance roller drive motor of the sheet conveyance path P1, drive motor M1 of the discharge roller 302 of the discharge path P3, a drive motor M2 of the aligning roller 305, a drive motor M3 of the sheet guide 306, or a drive circuit of the drive solenoid. Similarly, a rising and lowering drive motor M4 of the stacking tray 303, a turning motor M5 of the gripping conveyance means, a drive motor M6 of the main dampers 421 that grip the sheet bundle, and a drive circuit of the rising and lowering motor M7 that sends the sheet bundle to the adhesive application position, are linked to the control CPU 360.

Furthermore, a drive motor M8 that rotates the applicator roll 62 that applies adhesive, and a drive circuit of the drive motor M9 that moves the applicator roll 62 along the sheet bundle are connected to the control CPU 360. The drive motor M10 of the conveyance roller 69 that comprises the cover sheet conveyance means, the drive motor of the reverse rotation roller 68 and the stepping motor that shifts the aligning claw members 72 of the aligning unit 75 in an orthogonal direction of conveyance are linked to the control CPU 360. The detection sensors provided on each of the moving members, such as the sheet sensor Si of the sheet conveyance path P1, sheet sensor Se of the discharge outlet 301, and the grip sensor generate signals that are transmitted to the control CPU 360. The control CPU 360 executes the operations by calling up the bookmaking operation execution program from a memory ROM 365.

When the power to the system is turned on, the image forming apparatus A executes an initialization operation. This initialization operation detects whether a sheet is still in a path in the apparatus using sensors arranged in the paths, and prompts the operator to remove it with a jam signal, if a sheet remains. It detects the size of the print sheets stored in the sheet feeder cassette and stores that in memory. In the same way, the home position sensor detects whether the photoreceptor drum and print head are idling at predetermined positions, and prompts the operator with an error signal if they are not in their positions. When this initialization operation is ended, image forming is possible, but when there are other finishing processes provided on the bookbinding apparatus B, then the system job can be received, if the results signal of the initialization operation for the finishing apparatus is normal.

When the bookmaking mode or bookmaking cutting mode signal is received, the bookmaking apparatus B feeds the print sheet conveyed in by the sheet conveyance path P1 to the discharge path P3 by the path switching piece 300 and sequentially discharges it from the discharge outlet 301 by the discharge roller 302. With the signal from the discharge path sheet sensor Se, the aligning roller 305 rotates in the discharge direction (clockwise in FIG. 1) to guide the sheet to the stacking tray 303, and when the trailing edge of the sheet advances into the tray, aligning means, not shown, aligns the width direction of sheets at a reference position in an orthogonal direction to conveyance. Next, the aligning roller 305 rotates in an opposite direction (counterclockwise in FIG. 1) to backup the sheet along the tray where its trailing edge engages the aligning member 304 and stops. At this time, the sheet guide 306 presses to guide the sheet on the tray to the aligning member 304. Repeating this stacking operation stacks up sheets on the tray to form a bundle.

When an end signal (called a job end signal below) is received for the predetermined number of prints from the image forming apparatus A, the CPU 360 drives the tray rising and lowering motor M4 to lower the stacking tray 303 a predetermined amount (arrow "a" in FIG. 2). When this happens, the movable clamper 421 (FIG. 3) that composes the gripping conveyance means 420 separates from the fixed clamper 422 (FIG. 3) and is positioned at the dotted lines in FIG. 2, to receive the sheet bundle from the stacking tray 303. The drive motor M6 (FIG. 3) drives to grip the sheet bundle with the movable clamper 421 and fixed clamper 422. The gripping sensor Sg detects this state and at the same time, the sheet bundle thickness detection sensor Sa (not shown) detects the thickness of the gripped sheet bundle. After a predetermined amount of time from the signal that the sheet is gripped, detected by the gripping sensor Sg, the control CPU 360 rotatingly drives the turning motor M5 to turn the gripping conveyance means 420 90 degrees from the state of the dotted lines in FIG. 2 to the state of the solid lines so that it is in a vertical posture. After that, the rising and lowering motor M7 drives to send the sheet bundle to the predetermined adhesive application position X-X and stops.

The control CPU 360 issues a cover sheet supply instruction signal at the job end signal. With this signal, the sheet is supplied from either the inserter J, or from the image forming apparatus A, i.e., the sheet is conveyed to the sheet conveyance path P1, depending on the mode selection means. The cover sheet is conveyed to the cover sheet conveyance path P4 by the path switching piece 300. The cover sheet conveyance means comprising the conveyance roller 69 feeds back the cover sheet by the reverse rotating roller 68 after a predetermined time after the sheet trailing edge detection signal, generated by the sheet sensor Si, to engage the sheet trailing edge against the nipping claw members 72, thereby align the sheet.

The operation solenoid of the nipping claw members 72 then drives to nip the sheet trailing edge with the nipping claw members 72 and shift the nipping claw members 72 with a drive motor, not shown, in the direction orthogonal to conveyance and align the sheet to a predetermined position. Shown in the FIG. 5, the reference position is determined from the ON/OFF information of the plurality of sensors arranged in the sheet width direction and cover sheet size information, and when the sheet side edge matches the reference position, the shifting of the nipping claw members 72 stops.

After a predetermined amount of time from the signal when the sensor at this reference position detected the sheet, stepper motor M10 rotatably drives the conveyance roller 69. The control CPU 360 determines the conveyance amount so that the center of the cover sheet matches the binding position, and according to that determination, controls the pulses applied to the drive motor. Note that because the sheet bundle is conveyed to the bookmaking path P5 with the fixed damper 422 as a reference, it is necessary to change the center position of the cover sheet according to the thickness of the sheet bundle. The conveyance amount is adjusted based on the thickness information from the sheet bundle thickness detection sensor Sa (not shown).

Next, after the conveyance roller 69 starts, the control CPU 360 stops the drive motor M10 after driving according to the determined conveyance amount. In this way, the cover sheet reaches the binding position and stops (conveyance is set). The control CPU 360 then moves the opening and closing plates 63*b* that compose the conveyance guide from the solid lines in FIG. 2 to the dotted line position to open the bookmaking path P5. Next, the control CPU 360 starts the adhesive application operation.

As described above, the sheet bundle is held at the adhesive application position X-X (FIG. 2) by the gripping conveyance means 420 while the applicator roll 62 idles at the home position. Then, the control CPU 360 rotatingly drives the drive motor M9 to move applicator roll 62 together with the container 61 to the left side of FIG. 4, and at the same time, determines the amount of travel of the applicator roll 62 from the sheet size information. By reversing the drive motor for the amount of travel according to the sheet size, the applicator roll 62 moves from the return position RP to the idling position WP. The applicator roll 62 presses its surface against the sheet bundle and moves with an outward movement (movement from the idling position WP to the return position RP applying adhesive using the applicator roll 62. The applicator roll 62 then forms a gap with the bottom edge of the sheet bundle and applies adhesive while moving in the return direction (movement from the return position RP to the idling position WP). The gap is adjusted according to the thickness of the sheet bundle.

When the application of adhesive to the sheet bundle is completed, the control CPU 360 drives the rising and lowering motor M7 of the gripping conveyance means 420 to move the sheet bundle downstream of the bookmaking path P5. When this occurs, the cover sheet is set at the cover sheet conveyance path P4 at the binding position 150 of the downstream side, so the cover sheet and sheet bundle are joined in an upside-down T shape. At this time, the backup member 151 supports the backside of the cover sheet at the binding position 150. Next, when the control CPU 360 moves the left and right pair of folding blocks 155 from a position where they are separated in FIG. 2 to a position where they are nipping the cover sheet, the sheet bundle and cover sheet are pressed at the backside and are formed into a booklet. After this, the control CPU 360 moves the backup member 151 and folding blocks 155 away from the bookmaking path P5, and the sheet bundle is handed over to the folding rollers 160 downstream by the gripping conveyance means 420. Next, the operations of cutting the sheet bundle and storing it are executed as described above in the "Cutting Unit" section.

As is clear from the explanation above, when applying adhesive using adhesive application means (the applicator roll 62 described above) to a sheet bundle held at the adhesive application position by sheet holding means (the gripping conveyance means 420 described above), the cover sheet is conveyed and set at the downstream binding position. The opening and closing plates 63*b* that guide the sheet bundle are outside of the bookmaking path P5, so that paper jams are not possible when conveying a cover sheet. Furthermore, because the adhesive is not applied to the sheet bundle until the cover sheet is positioned, there is no problem of adhesive hardening when recovering from a malfunction. Even if adhesive applied to the bottom edge of the sheet bundle drips, the cover sheet is set and the binding center position is centered so the cover sheet is not soiled.

The disclosure of Japanese Patent Application No. 2005-265933 filed on Sep. 13, 2005 is incorporated as a reference.

While the invention has been explained with reference to the specific embodiments of the invention, the explanation is illustrative and the invention is limited only by the appended claims.

What is claimed is:

1. Bookmaking apparatus comprising:

a sheet conveyance path, a stacking tray for receiving sheets transferred from the sheet conveyance path through a first discharge path and stacking the sheets substantially horizontally, gripping conveyance means for holding the sheets on the stacking tray as a sheet bundle, said gripping conveyance means moving the sheet bundle in a substantially vertical position at a predetermined adhesive application position and conveying the sheet bundle from the adhesive application position downwardly in a substantial vertical direction;

adhesive application means for applying adhesive to the sheet bundle at the adhesive application position;

a cover sheet conveyance path for transferring a cover sheet from the sheet conveyance path to a position below the adhesive application position;

cover sheet conveyance means for conveying the cover sheet through the cover sheet conveyance path to the position below adhesive application position;

a second discharge path provided at a downstream side of the cover sheet conveyance path;

a stacker provided at a downstream side of the second discharge path, said stacker stacking a printed sheet transferred through the cover sheet conveyance path and the second discharge path in a printing process mode; and aligning means formed separately from the cover sheet conveyance means, said aligning means aligning the cover sheet in a direction perpendicular to a conveying direction of the cover sheet conveyance means to be located at a binding position, wherein the sheet bundle transferred by the gripping conveyance means is bound to the cover sheet at the binding position, wherein the adhesive application means is configured to start applying adhesive to the sheet bundle after the cover sheet is set at the binding position by the cover sheet conveyance means.

2. The bookmaking apparatus according to claim 1, wherein the cover sheet conveyance means is configured to convey and set the cover sheet in a substantially horizontal direction from a predetermined feeding position to the binding position.

3. The bookmaking apparatus according to claim 1, wherein the adhesive application means comprises an applicator roll configured to apply adhesive to an edge of the sheet bundle, and drive means for moving the applicator roll from one edge to the other edge of the sheet bundle; the cover sheet conveyance means comprises conveyance roller means for conveying the cover sheet from a predetermined feeding position to the binding position; and the drive means includes control means for starting movement of the applicator roll from the one edge of the sheet bundle to the other edge when the cover sheet is conveyed and set at the binding position by the conveyance roller means.

4. The bookmaking apparatus according to claim 3, wherein the applicator roll is configured to move between a moving position configured to apply adhesive from the one edge of the sheet bundle to the other edge and an idling position retracted from the moving position; and the control means controls the drive means for moving the applicator roll from the idling position to the moving position after the cover sheet conveyance means sets the cover sheet at the binding position.

5. The bookmaking apparatus according to claim 4, wherein the idling position is set in a, direction orthogonal to conveyance outside a conveyance region of the cover sheet conveyed by the cover sheet conveyance means.

6. The bookmaking apparatus according to claim 1, further comprising a conveyance guide member configured to guide the cover sheet between the adhesive application position and the binding position;

wherein the conveyance guide member comprises an opening and closing guide plate configured to expose the cover sheet to the adhesive application position; and the guide plate comprises opening and closing means for opening when applying adhesive using the adhesive application means.

7. The bookmaking apparatus according to claim 1, wherein the aligning means includes cover sheet transfer direction aligning means for aligning the cover sheet in the conveyance direction of the cover sheet before an aligning operation by the aligning means.

8. The bookmaking apparatus according to claim 1, wherein said aligning means comprises a stopper step for aligning an edge of the cover sheet, and a claw member for nipping the cover sheet at the edge thereof, said stopper step and the claw member being moved in the direction perpendicular to the conveying direction of the cover sheet.

9. An image forming system comprising:

an image forming apparatus for forming an image on a sheet;

a stacking tray configured to stack sheets from the image forming apparatus as a sheet bundle; and said bookmaking apparatus according to claim 1.

* * * * *